US010500887B1

(12) United States Patent
Kelly

(10) Patent No.: US 10,500,887 B1
(45) Date of Patent: Dec. 10, 2019

(54) GREETING CARD WITH 90-DEGREE POP-UP STRUCTURE

(71) Applicant: American Greetings Corporation, Cleveland, OH (US)

(72) Inventor: Charles Robert Kelly, Amherst, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 16/180,155

(22) Filed: Nov. 5, 2018

(51) Int. Cl.
*B42D 15/04* (2006.01)
*G09F 1/06* (2006.01)

(52) U.S. Cl.
CPC ..... *B42D 15/045* (2013.01); *G09F 1/06* (2013.01)

(58) Field of Classification Search
CPC ..... B42D 15/045; G09F 1/06
USPC ..... 40/124.08, 539; 446/148
See application file for complete search history.

(56) References Cited

U.S. PATENT DOCUMENTS 2,742,723 A 11/1930 Klein et al.
1,840,622 A * 1/1932 Einson ..... G09F 1/06 40/539
2,113,238 A * 4/1938 Ouwerkerk ..... G09F 1/08 211/73
5,317,823 A 7/1994 Brunt, III
5,588,233 A 12/1996 Volkert et al.
5,864,973 A 2/1999 Cole
6,311,418 B1 11/2001 Crowell
6,871,433 B2 * 3/2005 Anza' ..... G09F 1/10 40/124.08
9,469,146 B2 10/2016 Bogdanski et al.
9,475,333 B2 10/2016 Yeh
9,524,658 B1 12/2016 Wise et al.
9,601,033 B2 3/2017 Wise et al.
9,836,997 B1 12/2017 Bandrup
9,842,516 B2 12/2017 Yeh
2005/0081412 A1 * 4/2005 Malkovas ..... G09F 1/04 40/124.08
2012/0266504 A1 10/2012 Michlin

* cited by examiner

*Primary Examiner* — Joanne Silbermann
(74) *Attorney, Agent, or Firm* — Christine Flanagan

(57) ABSTRACT

A greeting card with 90-degree pop-up structure which contains multiple panels which pop-up when the greeting card is opened. The panels of the pop-up structure are connected by way of one or more struts which are inserted through some panels of the pop-up structure and attached to others but are not connected to the greeting card. The struts may or may not be attached to the greeting card.

8 Claims, 4 Drawing Sheets

GREETING CARD WITH 90-DEGREE POP-UP STRUCTURE

RELATED APPLICATIONS

There are no applications related to this application.

FIELD OF THE INVENTION

The present invention is in the field of social expression products such as greeting cards. More specifically, this invention is directed to a greeting card having multiple 90-degree pop-up panels with a unique support mechanism.

SUMMARY OF THE INVENTION

In one embodiment, the pop-up greeting card of the present disclosure and related inventions includes at least two greeting card panels attached along a fold line, two or more pop-up panels attached to one of the at least two greeting card panels, and one or more struts extending through or attached to two or more pop-up panels. When the greeting card is in a closed position, the two or more pop-up panels are in a flat stacked arrangement between the at least two greeting card panels and when the greeting card is in an open position, the two or more pop-up panels are in a fully upright position.

In another embodiment, the pop-up greeting card includes a greeting card body, a pop-up structure comprising a plurality of panels attached to the greeting card body, and at least one strut which connects at least two of the plurality of panels in the pop-up structure. The at least one strut is not attached to the greeting card body.

In another embodiment, the pop-up greeting card includes a greeting card body, a pop-up structure which includes a plurality of panels and one or more struts which connect one or more of the plurality of panels. The pop-up structure is operative to move between a first position wherein the plurality of panels and one or more strut of the pop-up structure are folded in a stacked, parallel arrangement between the greeting card body and a second position wherein the plurality of panels of the pop-up structure are unfolded into a fully upright position, each of the plurality of panels being parallel to each other panel and the one or more struts being perpendicular to each of the plurality of panels of the pop-up structure.

DETAILED DESCRIPTION OF PREFERRED AND ALTERNATE EMBODIMENTS

The greeting card 100 of the present disclosure and related inventions contains a 90-degree pop-up structure 12 which contains multiple panels 12A, 12B, etc., which pop-up when the greeting card 100 is opened.

The greeting card body contains two greeting card panels 14A, 14B. A first greeting card panel 14A is attached to a second greeting card panel 14B along a fold line F1. In one embodiment, the greeting card 100 is positioned in a vertical configuration where the fold line F1 connects the bottom or lower edge of the first greeting card panel 14A to a top or upper edge of the second greeting card panel 14B. The greeting card 100 opens in an upward direction by moving the first or upper greeting card panel 14A away from the second or lower greeting card panel 14B by pivoting the first or upper greeting card panel 14A about the fold line F1. In other embodiments, the greeting card may be vertically oriented with two panels attached along a side edge (and open by pivoting the first or left side panel away from the second or right side panel along the fold line). The greeting card body may be made of paperboard, cardboard, or any other suitable material.

Figure 1:
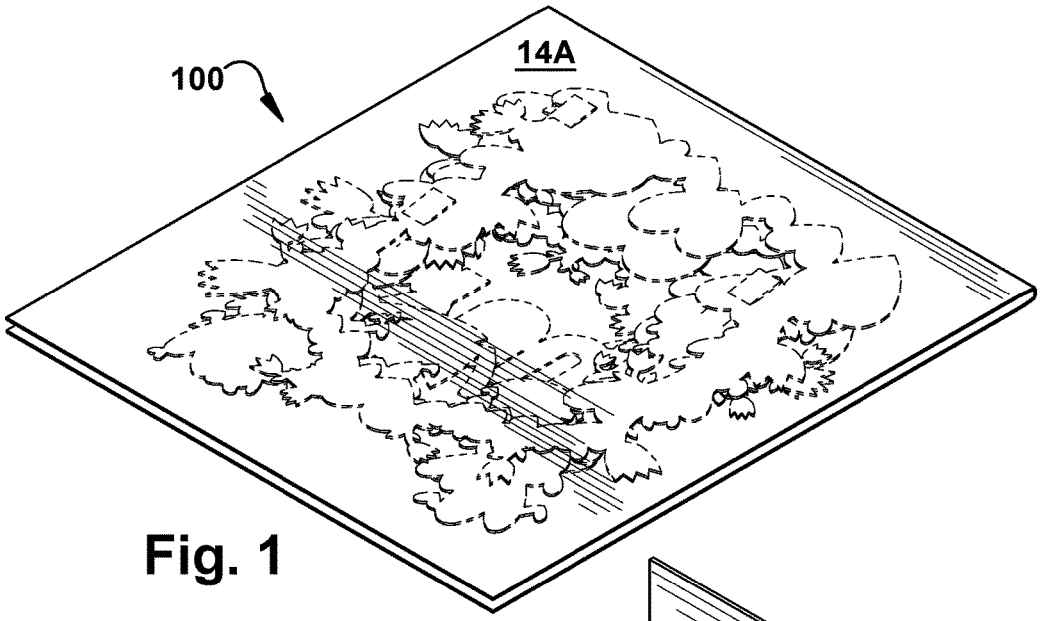
FIG. 1 is a perspective view of the greeting card of the present invention, in a closed position.
Figure 2:
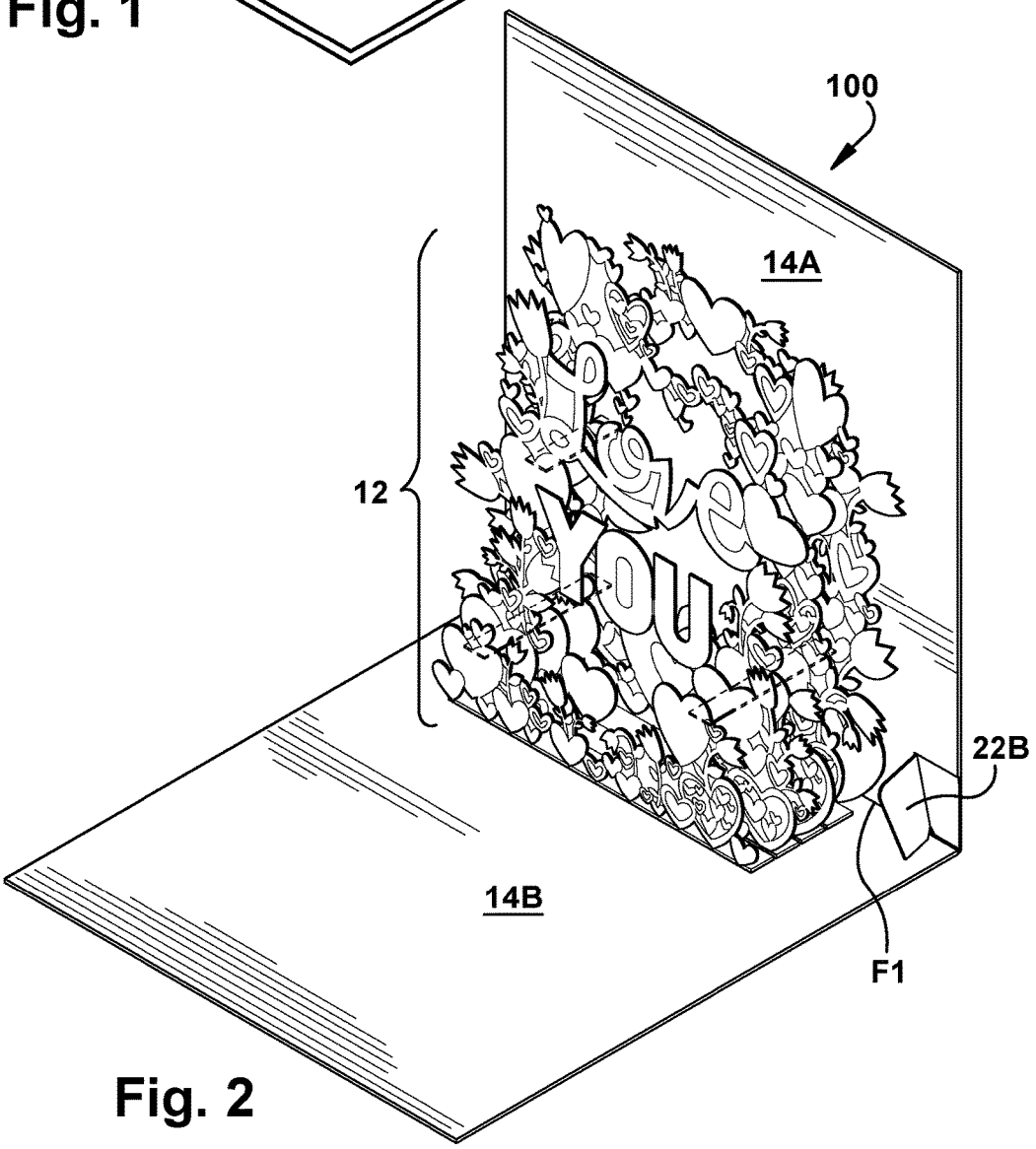
FIG. 2 is a perspective view of the greeting card of FIG. 1, in an open position.
Figure 3:
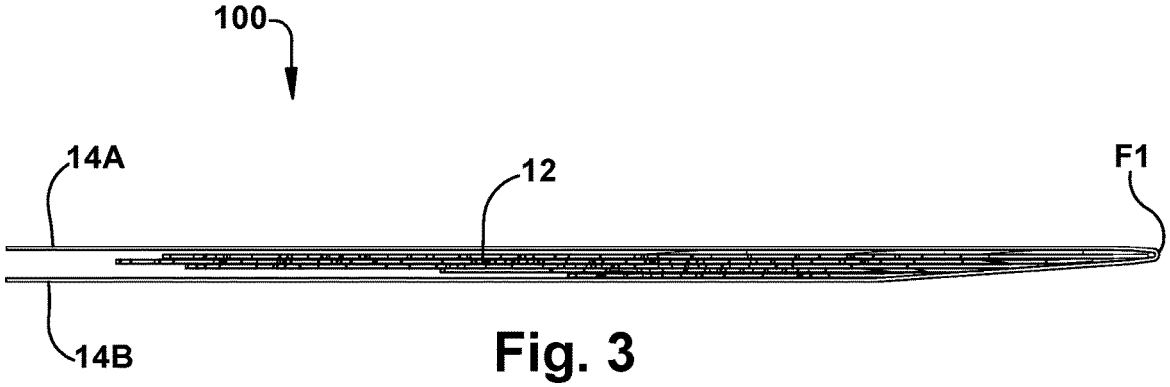
FIG. 3 is a right side view of the greeting card of FIG. 2.
Figure 4:
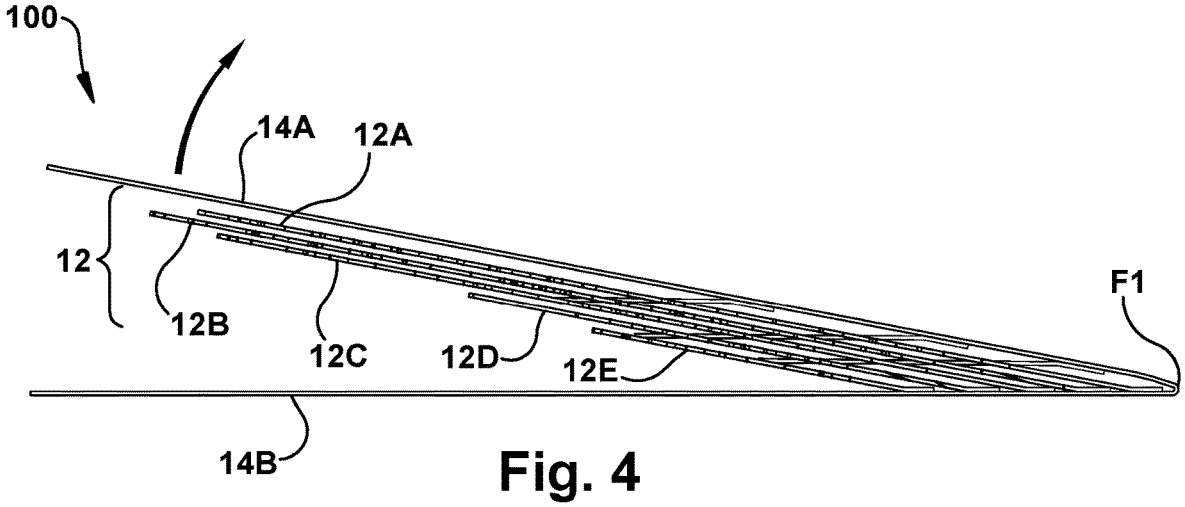
FIG. 4 is a right side view of the greeting card of FIG. 3, in a slightly open position.
Figure 5:
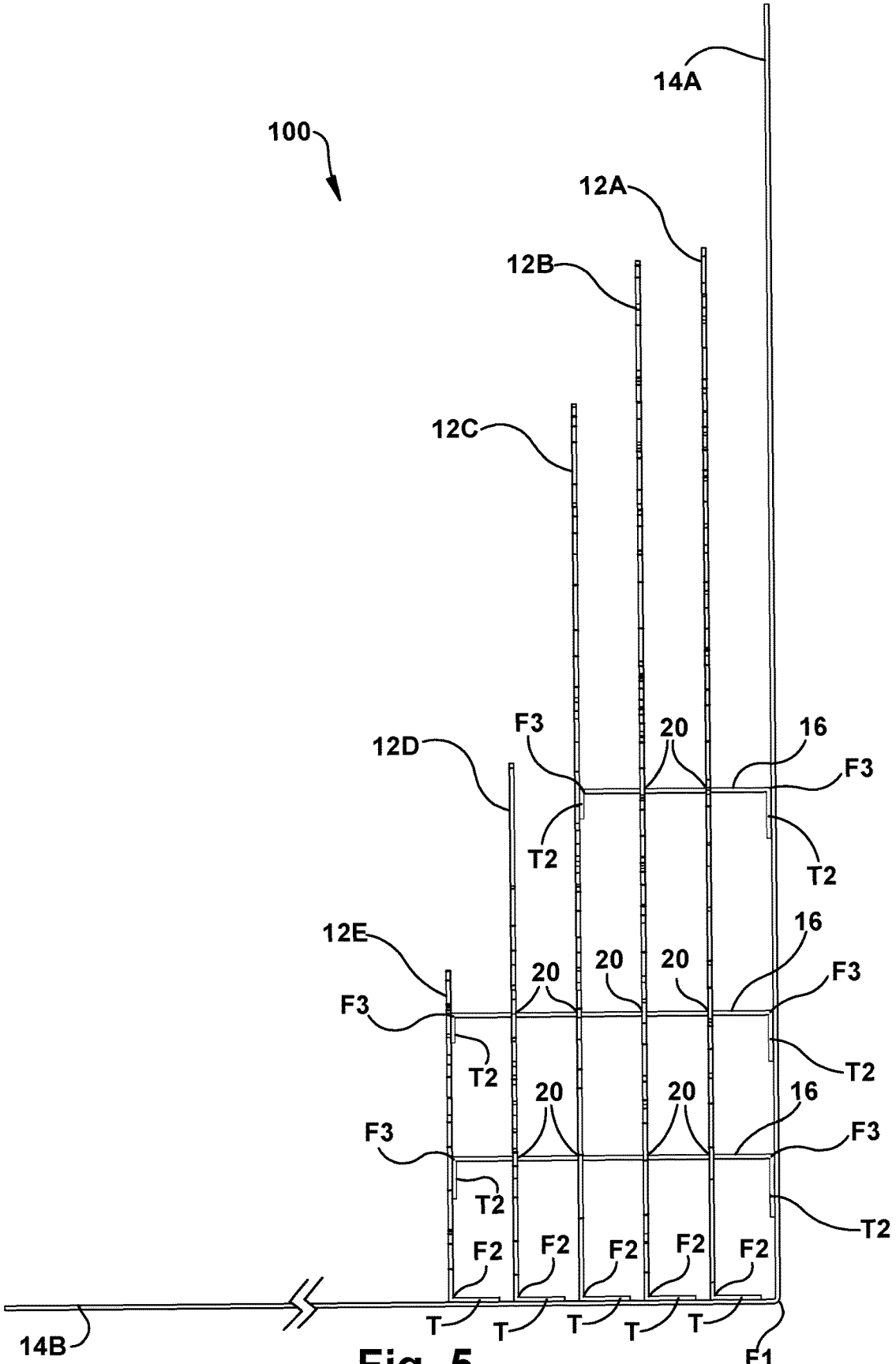
FIG. 5 is a right side view of the greeting card of FIG. 1.

A pop-up structure 12 is contained between the two greeting card panels 14A, 14B of the greeting card 100. The pop-up structure 12 contains two or more panels 12A, 12B, etc. In one embodiment, each of the two or more panels of the pop-up structure 12 is attached to a tab member T along a horizontal fold line F2. Each tab member T is folded along the horizontal fold line F2 such that the tab member T is perpendicular to the pop-up panel to which it is attached. The tab members T of each panel are then connected to the second or lower panel of the greeting card body 14B via glue or any other attachment mechanism. Each pop-up panel is pivotable about the fold line F2 between the tab member T and pop-up panel. In one embodiment, each panel etc. of the pop-up structure 12 is in a parallel configuration with every other panel of the pop-up structure 12. Each pop-up panel can be of different sizes, shape and outlines. The panels of the pop-up structure 12 may each contain decorative effects, including but not limited to: intricate designs with various cutouts, decorative printing, material finishings (such as foil, glitter, etc.) and/or other such effects. The designs may spell out words or phrases or contain various shapes and sizes and an overall scene. Each pop-up panel of the pop-up structure 12 is located at varying distances away from the fold line F1 bisecting the two greeting card panels 14A, 14B. In one embodiment, each pair of adjacent pop-up panels are spaced apart from one another at a specified, consistent distance. In other embodiments, each pair of adjacent pop-up panels may be spaced apart at a distance which is different from the distance which exists between two other adjacent pop-up panels. Together the two or more pop-up panels of the pop-up structure 12 create a three-dimensional scene similar to a diorama. The parallel, spaced apart arrangement and the different heights and widths of each of the two or more pop-up panels creates a depth effect to the decorative scene. The first or upper greeting card panel 14A may additionally contain printing or other embellishments thereon which are a part of the overall decorative scene. Each pop-up panel is operative to move between a first position wherein they are in a flat or prone position, as shown in FIGS. 2 and 3, and a second position wherein they are fully upright, as shown in FIGS. 1 and 5. The pop-up panels move simultaneously between the first and second positions by opening the greeting card 100. This is accomplished by means of one or more struts 16 which are described in further detail below.

Figure 6:
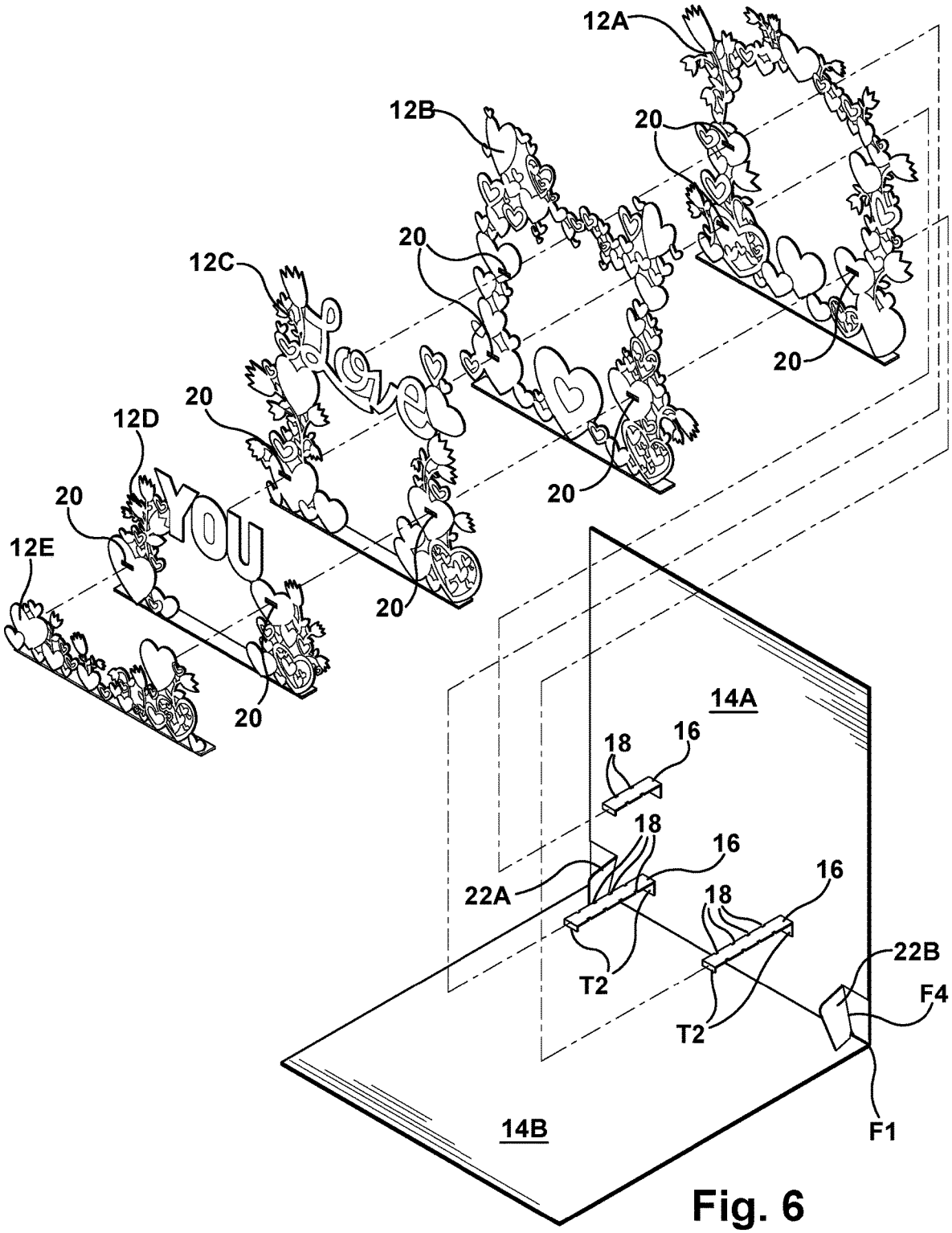
FIG. 6 is an exploded view of the greeting card of 1.

The panels of the pop-up structure 12 are interconnected by means of one or more struts 16. The struts 16 are operative to move the two or more pop-up panels between the first and second positions upon a user opening the greeting card 100. The struts 16 interconnect the pop-up panels such that opening the greeting card 100 causes all of the pop-up structure 12 to move from the first (FIGS. 2 and 3) to second (FIGS. 1 and 5) positions in unison. Each strut 16 is a relatively planar element having pairs of notches 18 on opposing edges thereof, as shown in FIG. 6. Each notch 18 is a small square-shaped cutout. The struts 16 may have varying lengths and may interact with all of the panels contained in the pop-up structure 12 or fewer than all of the panels or a sub-group of panels contained in the pop-up structure 12. In one embodiment, the struts 16 are not attached to the greeting card 100 itself but only to other panels in the pop-up structure 12. To interconnect various panels of the pop-up structure 12, a strut 16 extends through or attaches to each connected panel. One or more panels of the pop-up structure 12 contain one or more slots or apertures 20 thereon through which a strut 16 may pass through, as shown in FIG. 6. The slots or apertures 20 have a width dimension which is less than the width dimension of the struts 16 such that when the strut 16 is inserted through a pop-up panel, the panel sits within one pair of opposing notches 18 on the strut 16. The notches 18 help to maintain the panel in its appropriate upright position but also allow some movement to enable the panel to be folded into a flat position. The number of struts 16 needed depends on the number and configuration of panels in the pop-up structure 12. The number of pairs of notches 18 and the distance between said pairs of notches 18 depends on which panels are to be connected and the distance between said panels. Therefore, the struts 16 may be of different lengths and may contain a different number of pairs of notches 18 along the length thereof. Each strut 16 contains one or more tab members T2 which are attached the strut 16 along a fold line F3. The tab member T2 gets folded along the fold line F3 such that the tab T2 is in a perpendicular position with reference to the strut 16. A strut 16 gets inserted through one or more panels to interconnect at least two panels and maintain the positioning of said panels within the pop-up structure 12. Since the struts 16 are able to intersect one or more panels of the pop-up structure 12, it prevents the need to attach each and every panel of the pop-up structure 12 to one another or to attach each and every panel directly to a greeting card panel 14A, 14B. This allows for the use of fewer struts 16 or connection mechanisms between panels of the pop-up structure 12 and greeting card panels 14A, 14B.

When the greeting card 100 is in the first or closed (folded) position, the struts 16 and the panels of the pop-up structure 12 are in a stacked parallel arrangement between the two greeting card panels 14A, 14B, as shown in FIG. 3. When the greeting card 100 is in the second or open (unfolded) position, the struts 16 are perpendicular to the panels of the pop-up structure 12, as shown in FIG. 5. A u-shaped tab member may be used to attach the greeting card (first or upper panel 14A) to the rearmost panel (panel closest to the first or upper panel 14A of the greeting card 100) of the pop-up structure 12.

The greeting card 100 may additionally include a pair of locking tabs 22A, 22B which are operative to hold the greeting card 100 in an open position with the pop-up structure 12 in its fully upright position. In one embodiment, the locking tabs 22A, 22B are integral with the first or upper greeting card panel 14A at the lower edge thereof, as shown in FIG. 6. A cut in the first or upper greeting card panel 14A, combined with a fold line F4, allows the locking tabs 22A, 22B to be moved away from the first or upper greeting card panel 14A. To do so, the locking tabs 22A, 22B are each folded along the fold line F4 so that the locking tabs 22A, 22B are in a perpendicular position with respect to the first or upper greeting card panel 14A. The locking tabs 22A, 22B then operate as a kickstand or locking mechanism which allows the greeting card 100 to remain in an open position thereby displaying a fully upright pop-up structure 12.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A pop-up greeting card comprising:

at least two greeting card panels attached along a fold line;

two or more pop-up panels attached to one of the at least two greeting card panels;

one or more struts, each of the one or more struts connecting at least two of the two or more pop-up panels to one of the at least two greeting card panels, wherein each of the one or more struts extends through an opening in at least one of the two or more pop-up panels;

wherein when the greeting card is in a closed position, the two or more pop-up panels are in a flat stacked arrangement between the at least two greeting card panels and when the greeting card is in an open position, the two or more pop-up panels are in a fully upright position.

2. The pop-up greeting card of claim 1, wherein the two or more pop-up panels are parallel to one another.

3. The pop-up greeting card of claim 1, wherein each strut contains at least one pair of opposing notches along the length thereof.

4. The pop-up greeting card of claim 3, wherein at least a portion of the two or more pop-up panels is contained within the at least one pair of opposing notches.

5. The pop-up greeting card of claim 1, wherein the one or more struts may be of differing lengths.

6. A pop-up greeting card comprising:

a greeting card body;

a pop-up structure comprising:

a plurality of panels;

one or more struts which connect two or more of the plurality of panels;

wherein the pop-up structure is operative to move between a first position wherein the plurality of panels and one or more strut of the pop-up structure are folded in a stacked, parallel arrangement between the greeting card body and a second position, wherein the plurality of panels of the pop-up structure are unfolded into a fully upright position, each of the plurality of panels being parallel to each other panel and the one or more struts being perpendicular to each of the plurality of panels of the pop-up structure;

and wherein the one or more struts are inserted through an aperture in at least one of the plurality of panels in the pop-up structure.

7. The pop-up greeting card of claim 6, wherein the plurality of panels contain various cut-out portions.

8. The pop-up greeting card of claim 6, wherein each of the plurality of panels takes on a different shape.

* * * * *